US005427543A

United States Patent [19]

Dynia

[11] Patent Number: 5,427,543

[45] Date of Patent: Jun. 27, 1995

[54] ELECTRICAL CONNECTOR PRONG LOCK

[76] Inventor: Gregory G. Dynia, 6517-F Woodlake Village Ct., Midlothian, Va. 23112

[21] Appl. No.: 235,874

[22] Filed: May 2, 1994

[51] Int. Cl.[6] ..... H01R 4/50

[52] U.S. Cl. ..... 439/346

[58] Field of Search ..... 439/345, 346, 369, 507

[56] References Cited

U.S. PATENT DOCUMENTS 2,528,121 10/1950 Dickinson ..... 439/346 X
2,801,394 7/1957 Derner et al. ..... 439/346
3,942,856 3/1976 Mindheim et al. ..... 439/346 X
4,136,919 1/1979 Howard et al. ..... 439/346

*Primary Examiner*—Khiem Nguyen

[57] ABSTRACT

An electrical connector prong lock including a spring loaded insulating pin which is passed through a bearing member affixed to the electrical connector prong lock and through a hole commonly found near the end of a prong of a male electrical plug. A sliding cam member is employed to move the insulating pin member into and out of engagement. In an alternate embodiment the enlarged end of a ground return prong is engaged by a forked insulating member affixed to the electrical connector prong lock thereby preventing prong release.

1 Claim, 3 Drawing Sheets

ELECTRICAL CONNECTOR PRONG LOCK

BACKGROUND OF THE INVENTION

1. Field of the Invention

The present invention relates to electrical connectors and more particularly pertains to an electrical connector prong lock which may be employed to detachably lock together an electric plug and socket.

2. Description of the Prior Art

The use of electrical plug and socket locks is known in the prior art. More specifically, electrical plug and socket locks heretofore devised and utilized for detachably locking together an electrical plug and engaging socket are known to consist basically of familiar, expected and obvious structural configurations, notwithstanding the myriad of designs encompassed by the crowded prior art which have been developed for the fulfillment of countless objectives and requirements.

The present invention is directed to improving devices for an electrical connector prong lock in a manner which is safe, secure, economical and aesthetically pleasing.

For example, U.S. Pat. No. 4,183,603 to Donarummo discloses an extension cord lock comprising a simple clip for holding together an electric plug and socket on separate extension cords wherein the clip is an externally applied U-shaped semiflexible member holding the plug and socket in firm engagement. The present invention comprises a locking mechanism introduced within the socket member of an extension cord wherein an electrical appliance plug prong member may be detachably locked therein.

In U.S. Pat. No. 4,925,396 to Grover a latching mechanism for electrical plugs is disclosed. The Grover invention comprises an electrical plug-socket combination wherein the socket member is provided with sliding latch plates which fit transverse notches formed in the plug prongs thereby releasably latching the plug and socket together. The Grover invention is unable to accept and lockably secure an existing appliance plug. The present invention lockably engages an existing plug of an appliance by introducing an insulating pin member through a hole ordinarily found near a free end of one or more plug prong members and is therefore able to lock various appliance plugs to a socket of an extension cord without requiring that notches be disposed upon any plug prong member.

In U.S. Pat. No. 5,069,634 to Chiarolanzio a snap lock extension cord and power tool connector is described wherein a plug or socket member of an appliance or extension cord has disposed thereon a flexible finger having a locking tab, and a mating plug or socket member has an engaging hole disposed therein, and furthermore said engaging hole had an orthogonally disposed latching and disengagement hole perforating the outer surface of the mating plug or socket member. The locking tab engages the latching and disengagement hole when the plug and socket are engaged, and the plug and socket may be released from one another by applying finger pressure to the locking tab through the latching and disengagement hole while pulling the socket and plug couple apart. The Chiarolanzio invention has no provision for locking an existing appliance plug to a socket. The present invention employs a prong engagement pin to releasably lock an existing appliance plug to a socket and is usable with a wide variety of existing appliance plug types.

In U.S. Pat. No. 5,082,450 to Warren Sr. et al. a safety plug with ground lock and prong locks is disclosed for providing an electrical plug wherein prong connector parts are retractable to prevent use of the plug by small children, and furthermore the plug may be locked into an electrical outlet using a slidably engaging locking bar and a locking spring disposed upon portions of a grounding prong. A disadvantage in this prior art lies in a lack of provision for releasably locking an existing appliance plug within a socket particularly in interconnecting an appliance cord and an extension cord. The present invention releasably locks a variety of appliance plugs to and extension cord having a socket comprising a releasable prong locking pin disposed therein.

U.S. Pat. No. 5,041,010 to Collier discloses an electrical connector employing conductive pins and projections which connect insulated conductors to the pins by deformation of the pins and penetration of the insulated conductor. The disclosure teaches a plug and a receptacle wherein the plug is connected to an insulated cable and the receptacle is fitted with pins as typically employed in printed circuit board interconnections. The disclosure makes no provision for releasably locking an appliance plug to a socket affixed to an extension cord. Furthermore, there are no provisions for passage of large amounts of electrical power because the pins and conductor connection method is limited in current carrying capability and is generally unsuitable for several classes of power tools.

In this respect, the electrical connector prong lock according to the present invention substantially departs from the conventional concepts and designs of the prior art, and in so doing provides an apparatus primarily developed for the purpose of releasably locking an existing electrical appliance plug to an extension cord socket.

Therefore, it can be appreciated that there exists a continuing need for new and improved electrical connector prong lock which can be used to releasably secure an appliance plug to an extension cord socket thereby permitting safe and uninterrupted use while dragging or hanging portions of the power cord system during use. In this regard, the present invention substantially fulfills this need.

As illustrated by the background art, efforts are continuously being made in an attempt to improve electrical plug and socket locking techniques. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of electrical plug and socket locks now present in the prior art, the present invention provides an improved electrical connector prong lock construction wherein the same can be utilized for releasably locking an existing appliance plug to an extension cord socket. As such, the general purpose of the present invention, which will be described subsequently in greater detail, is to provide a new and improved electrical connector prong lock apparatus and method which has all the advantages of the prior art electrical connector locking apparatus and none of the disadvantages.

The invention is defined by the appended claims with the specific embodiment shown in the attached drawings. For the purpose of summarizing the invention, the invention may be incorporated into a socket member disposed at an end of an extension cord having a spring energized insulating locking pin which releasably engages the through hole of a prong member of an appliance plug disposed therein. The locking pin holds the plug and socket together during use of the appliance, and the plug and socket may be disengaged at any time by manual movement of a sliding cam which permits retraction of the locking pin and enables separation of the plug and socket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved electrical connector prong lock having a releasably engaging prong locking pin means for holding an existing electrical plug and a socket together.

It is therefore an additional object of the present invention to provide a new and improved electrical connector prong lock which has all the advantages of the prior art electrical connector locks and none of the disadvantages.

It is another object of the present invention to provide a new and improved electrical connector prong lock which may be easily and efficiently manufactured and marketed.

It is a further object of the present invention to provide a new and improved electrical connector prong lock which is of a durable and reliable construction.

An even further object of the present invention is to provide a new and improved electrical connector prong lock which is susceptible of a low cost of manufacture with regard to both materials and labor, and which accordingly is then susceptible of low prices of sale to the consuming public, thereby making such electrical connector prong locks economically available to the buying public.

Still yet another object of the present invention is to provide a new and improved electrical connector prong lock which provides in the apparatuses and methods of the prior art some of the advantages thereof, while simultaneously overcoming some of the disadvantages normally associated therewith.

Still another object of the present invention is to provide a new and improved electrical connector prong lock which permits releasable locking of a wide variety of electrical plug types to an extension cord socket.

Yet another object of the present invention is to provide a new and improved electrical connector prong lock which may be forcibly released under emergency conditions by a strong tug whereby an insulating prong engaging pin is sheared thereby releasing the plug from the socket.

Even still another object of the present invention is to provide a new and improved electrical connector prong lock which may be affixed to an existing extension cord as a replacement socket or be moldedly disposed upon a free end of a new extension cord during manufacture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 3:
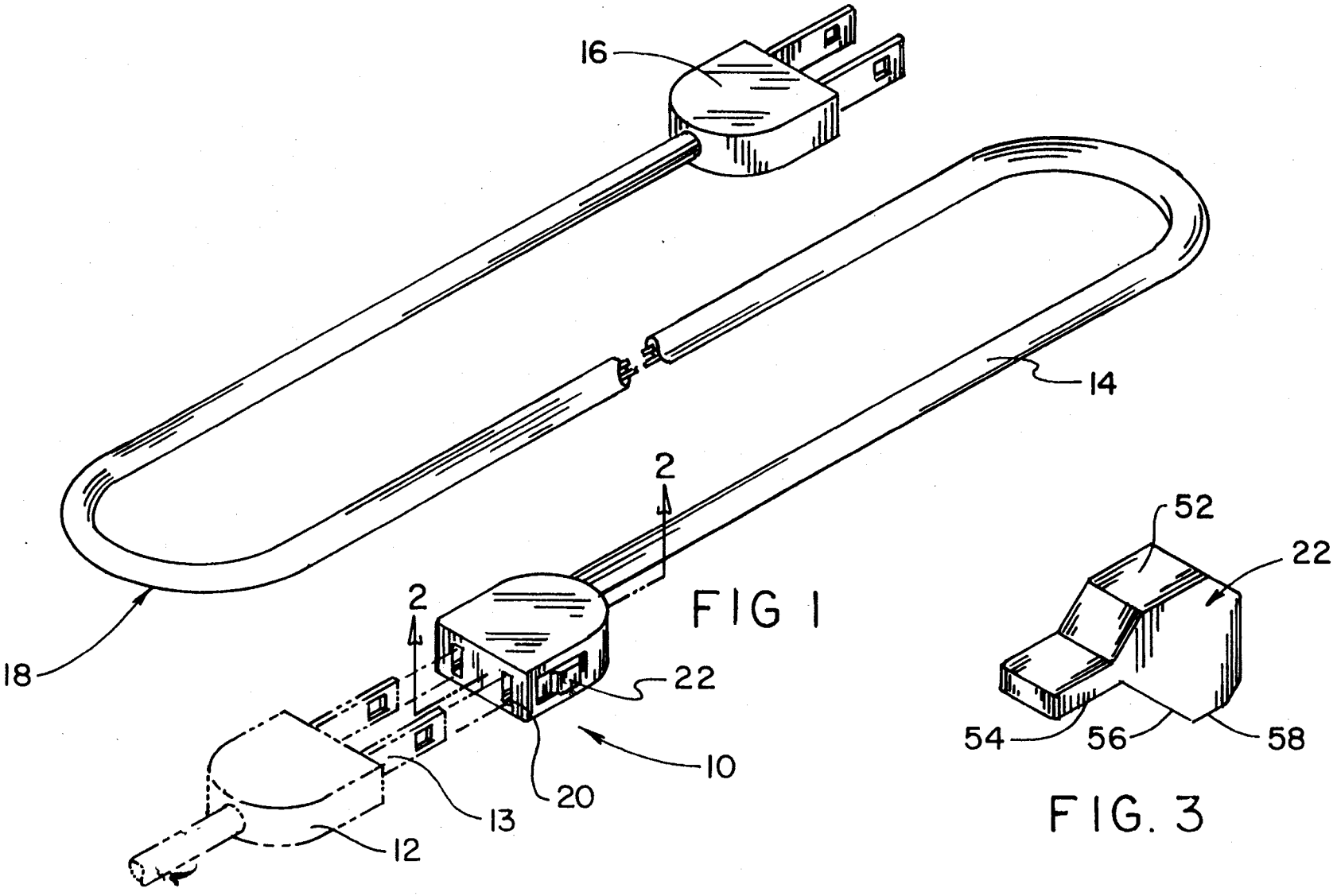
FIG. 1 is a right perspective view of the electrical connector prong lock showing the extension cord and mating appliance plug.
FIG. 3 is a perspective view of the electrical connector prong lock showing the slidably engaging actuator button.

With reference now to the drawings, and in particular to FIG. 1 thereof, a new and improved electrical connector prong lock embodying the principles and concepts of the present invention and generally designated by the reference numeral 10 will be described.

From an overview standpoint, the electrical connector prong lock 10 is adapted for use in detachably engaging conventional appliance plugs 12 having a plurality of prong members 13 and an extension cord. See FIG. 1. The electrical connector prong lock 10 is connectably affixed at an end of a multiconductor cable 14 having a multi-pronged electrical plug member 16 connectably affixed at an opposite end thereby forming an extension cord 18 of indeterminate length. Electrical connector prong lock 10 has two or more prong engagement slots 20 disposed at an end thereon and a slidably actuating prong lock mechanism which is operated by actuator button 22.

Figure 2:
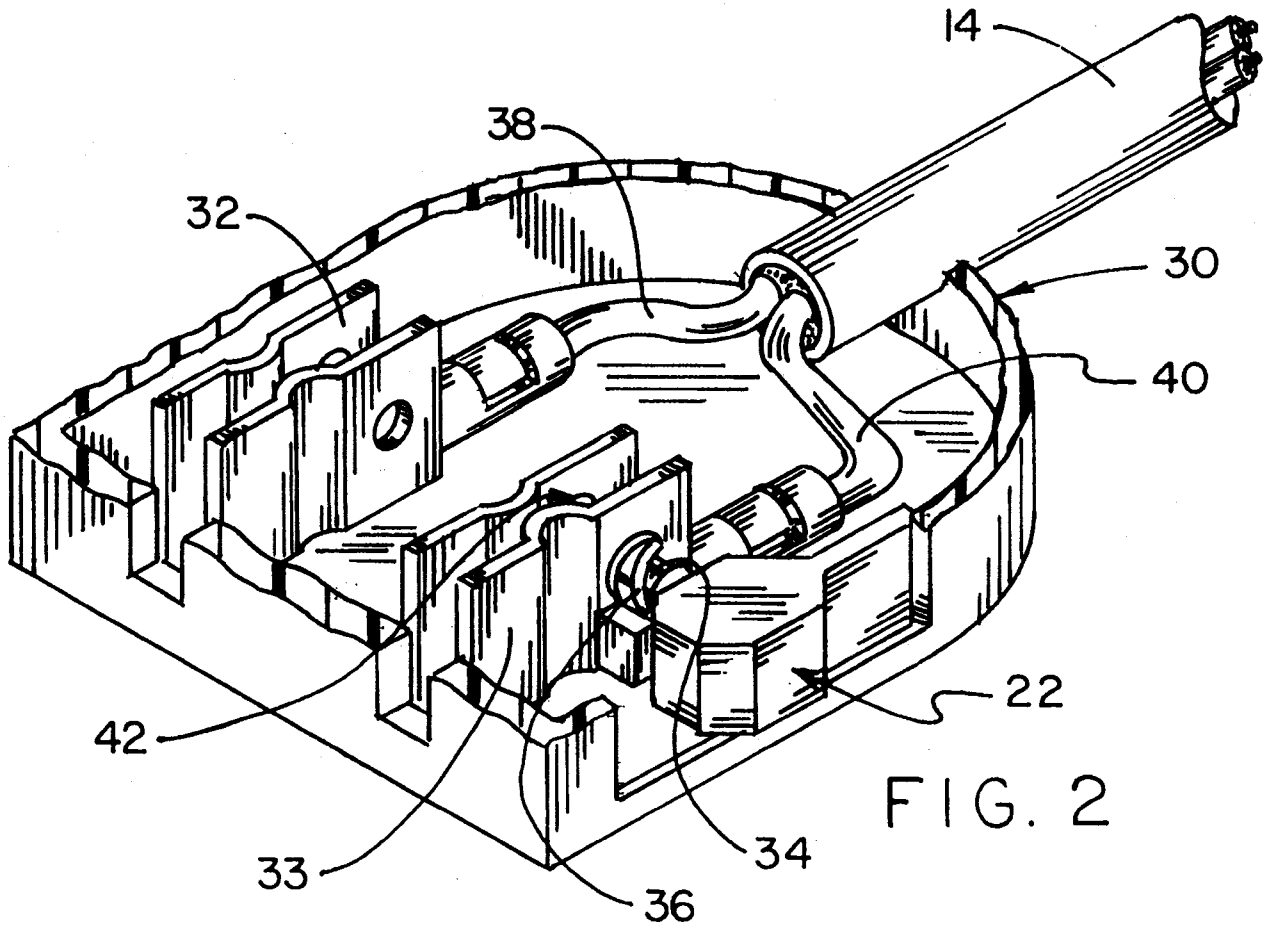
FIG. 2 is fragmentary sectional view of the electrical connector prong lock taken substantially upon the plane indicated by the section lines 2—2 of FIG. 1.

More specifically, it will be noted that the electrical connector prong lock 10 comprises a housing 30, a plurality of crimp style prong engaging connectors 32 and 33, a prong engagement pin 34, a pin restoring spring 36, and actuator button 22. See FIG. 2. Housing 30 comprises a durable insulating plastic or composite shell generally formed in two pieces and having provisions for holding connectors 32, pin 34, and button 22 in an operational disposition. A high potential conductor 38 of multiconductor cable 14 is crimpedly affixed to prong engaging connector 32. Prong engaging connector 32 is somewhat remotely positioned with respect to actuator button 22 to reduce the likelihood of accidental electrical shock should the pin 34 or button 22 become damaged or coated with conductive materials. A low potential or ground return conductor 40 of multiconductor cable 14 is crimpedly affixed to prong engaging connector 33.

Prong engagement pin 34 is able to pass through hole pair 42 and, whenever a plug 12 is insertably engaged, through an aligned hole in a plug prong disposed therebetween. Actuator button 22 comprises a cam portion 50 and a thumb engaging portion 52. See FIG. 3. Thumb engaging portion 52 frictionally engages the thumb or finger of the user for the purpose of locking or unlocking appliance plug 12 from electrical connector prong lock 10 by sliding action. Cam portion 50 of actuator button 22 comprises a first flat portion 54, a second sloped portion 56, and a third flat portion 58. An end of prong engagement pin 34 engages cam portion 50 and furthermore the engagement pin 34 is in a non-locking state when engaging first flat portion 34, a proceed to locked state when engaging cam portion 52, and a locked state when engaging cam portion 54.

Figure 4:
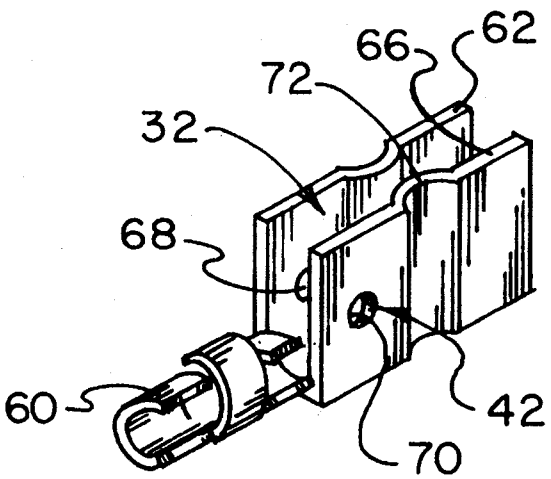
FIG. 4 is a perspective view of the electrical connector prong lock showing a crimp style prong engaging connector.

Actuator button 22 is of plastic composite or other electrically insulating construction. Prong engaging connector 32 comprises a singular conductive metallic composition generally having some springlike qualities and in preference being plated with electrically conductive, durable, non-corroding coatings. See FIG. 4. Prong engaging connector 32 may be formed as a part stamped from sheet stock or through other forming techniques. Prong engaging connector 32 has a crimpable portion 60, a first tab portion 62, an intermediate portion 64 and a second tab portion 66. Through hole pair 42 comprises a first through hole 68 perforating first tab portion 62 and a second through hole 70 perforating second tab portion 66.

Figure 5:
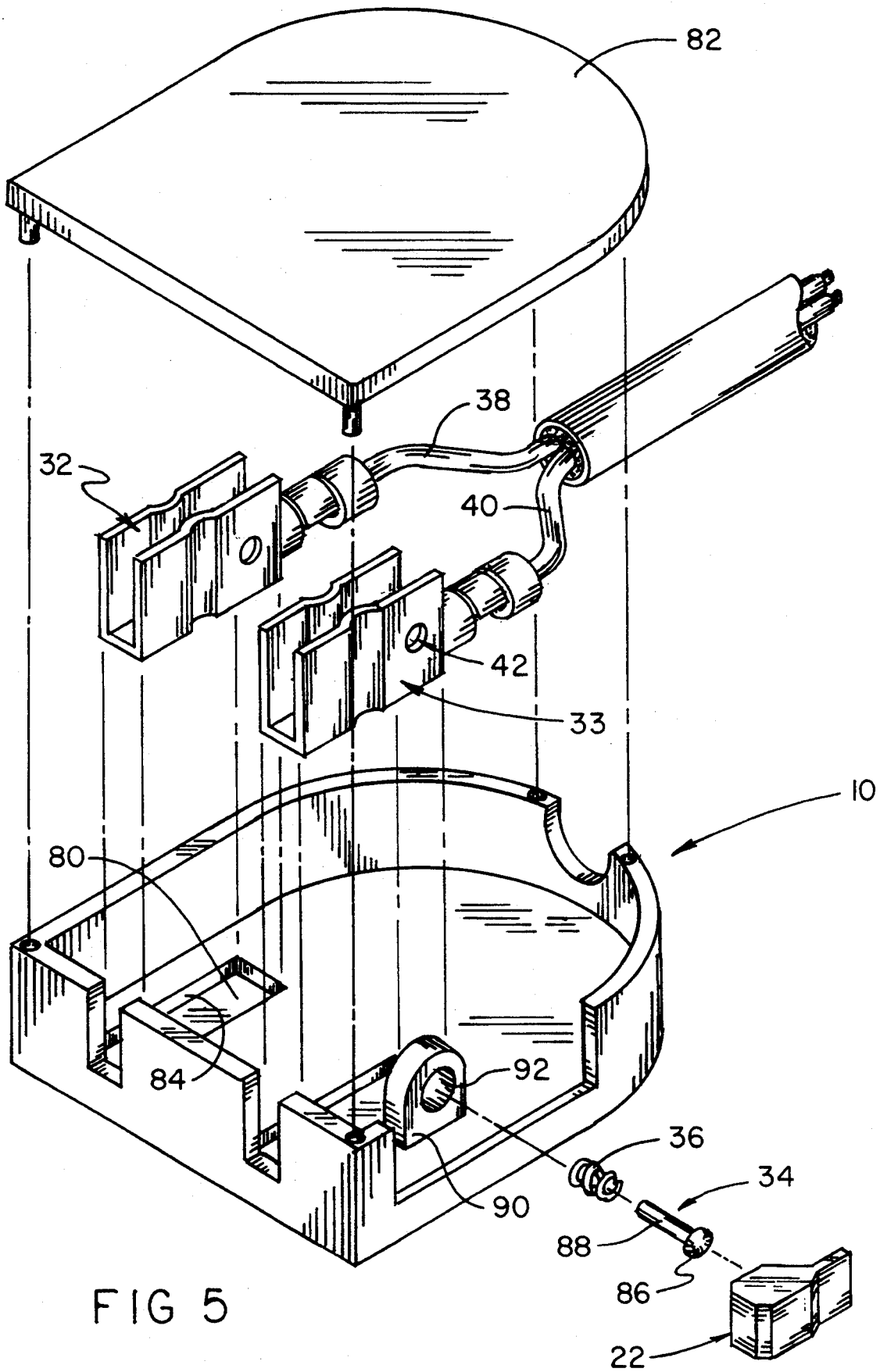
FIG. 5 is a fragmentary exploded perspective view of a electrical connector prong lock.

First through hole 68 and second through hole 70 are in substantial alignment thereby permitting unobstructed passage of prong engagement pin 34 therethrough. Prong engagement protrusions 72 frictionally engage an appliance plug 12 prong member 13 thereby providing low resistance electrical contact. Prong engaging connectors 32 and 33 are maintained in position within housing 30 by engaging depressions 80 and lid member 82. See FIG. 5. Depressions 80 preclude lateral motion of prong engaging members 32 and 33 by having a raised edge 84 disposed upon a periphery thereof. Lid member 82 loosely engages prong engaging connectors 32 and 33. Prong engagement pin 34 comprises a substantially cylindrical electrically insulating rod having a first end portion 86 and a body portion 88.

First end portion 86 comprises an expanded mushroom shaped formation engaging pin restoring spring 36 and actuator button 22. Body portion 88 comprises an elongated solid which slidably engages pin bearing member 90 wherein through hole 92 is in substantial alignment with hole pair 42 thereby permitting through penetration of prong engagement pin 34 to effect locking of prong member 13 within prong engagement connector 33. Pin restoring spring 36 comprises a helical compression spring maintaining engagement of prong engagement pin 34 with actuator button 22.

In an alternate embodiment, a generally widening blade free end of prong member 13 is employed for identification of the ground return, and furthermore the increased conductor volume provides greater return carrying capability for safety purposes. The widening blade may be locked by employing a bifurcated member which engages the enwidened prong thereby precluding removal.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. An electrical connector prong lock for releasably attaching an existing male electrical connector plug to a female receptacle comprising:

an electrically insulating pin member having a bifurcated end for insertably engaging a hole in a prong of an existing male electrical connector;

two prong engaging connectors wherein each prong engaging connector has two opposing through holes and wherein said insulating pin member is able to pass therethrough and wherein each prong engaging connector is electrically and mechanically connectable to an electrical conductor of an external cord member by crimping, a pin bearing member having a through hole for engaging said insulating pin member which is slidably insertable therein, a helical compressible pin restoring spring disposed around said insulating pin member, a manually positionable plastic actuator button formed of a cam portion and a thumb engaging portion for slidably and forcibly engaging said insulating pin member and pin restoring spring through actuation by a user and with said cam portion further having a first flat portion, a second sloped portion, and a third flat portion, said actuator button furthermore having a first unlocked position and a second locked position with said first unlocked position providing clearance for withdrawal of said insulating pin member by spring force and said second locked position forcing said insulating pin member into said through hole of said pin bearing member, said holes in one of said prong engaging connectors, and said substantially aligned hole in said prong of said existing male connector, and a durable insulating plastic housing further comprising a body member and a lid member interjoined by frictional snap engagement at one or more engagement locations, said body further having through holes formed therethrough for passage of an electrical cord and two or more male electrical plug prongs, two rectangular cavities formed thereon for maintaining position of said prong engagement members and with said pin bearing member coupled thereto at a location adjacent to one of said cavities.

* * * * *